US007775289B2

(12) United States Patent
McKee et al.

(10) Patent No.: US 7,775,289 B2
(45) Date of Patent: Aug. 17, 2010

(54) EQUIPMENT FOR INSTALLING A SPOOLABLE CONNECTOR IN COILED TUBING

(75) Inventors: L. Michael McKee, Friendswood, TX (US); Matthew E. Wilson, Eureka, KS (US); Geoffrey Steel, Aberdeenshire (GB); William D. Eatwell, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 243 days.

(21) Appl. No.: 11/466,329

(22) Filed: Aug. 22, 2006

(65) Prior Publication Data

US 2007/0068678 A1 Mar. 29, 2007

Related U.S. Application Data

(60) Provisional application No. 60/720,832, filed on Sep. 27, 2005.

(51) Int. Cl.
*E21B 19/16* (2006.01)
*E21B 19/22* (2006.01)

(52) U.S. Cl. ..... 166/380; 166/77.2; 166/77.51; 166/85.1

(58) Field of Classification Search ..... 166/378–380, 166/77.1, 77.2, 77.51, 85.1, 344, 347; 285/23, 285/39

See application file for complete search history.

(56) References Cited

U.S. PATENT DOCUMENTS

| | | | | |
|---|---|---|---|---|
| 4,019,334 | A * | 4/1977 | Sinclair et al. | 405/169 |
| 4,844,516 | A * | 7/1989 | Baker | 285/351 |
| 5,238,273 | A | 8/1993 | Laflin | |
| 5,251,695 | A | 10/1993 | Coronado | |
| 5,306,050 | A | 4/1994 | Laflin | |
| 5,452,923 | A * | 9/1995 | Smith | 285/123.11 |
| 6,158,784 | A * | 12/2000 | Lavender | 285/239 |
| 6,220,498 | B1 * | 4/2001 | Gordon et al. | 228/173.4 |
| 6,474,701 | B1 * | 11/2002 | Bowles et al. | 285/382.1 |
| 6,561,278 | B2 | 5/2003 | Restarick | |
| 6,766,858 | B2 | 7/2004 | Nguyen | |
| 2006/0243453 | A1 | 11/2006 | McKee | |
| 2007/0000669 | A1 | 1/2007 | McKee | |

OTHER PUBLICATIONS

SPE 89527—Development of a New Spoolable Mechanical Coiled Tubing Connector By H.B. Luft, SPE, L.E. Laun and P.B. Thov, BJ Services Company Canada.

* cited by examiner

*Primary Examiner*—Kenneth Thompson
(74) *Attorney, Agent, or Firm*—Michael L. Flynn; David Hofman; Robin Nava

(57) ABSTRACT

A technique facilitates joining of coiled tubing sections. A framework has one or more movable stands with features designed to grip and manipulate an end of a coiled tubing section. The ability to hold and selectively move an end of a coiled tubing section or the ends of both coiled tubing sections enables an operator to easily prepare the coiled tubing ends and to couple the coiled tubing ends with a coiled tubing connector.

27 Claims, 4 Drawing Sheets

EQUIPMENT FOR INSTALLING A SPOOLABLE CONNECTOR IN COILED TUBING

CROSS-REFERENCE TO RELATED APPLICATION

The present document is based on and claims priority to U.S. provisional application Ser. No. 60/720,832, filed Sep. 27, 2005.

FIELD OF THE INVENTION

The present invention relates to joining sections of coiled tubing. More specifically, the present invention relates to an assembly skid for connecting two segments of coiled tubing. Once the segments of coiled tubing are held in the assembly skid, the coiled tubing can be prepared for the installation of a connector and then secured to the connector.

BACKGROUND

When performing coiled tubing services, if the amount of coiled tubing required to perform the service cannot be contained on a single reel as one continuous length of pipe, two or more sections of coiled tubing must be joined together. The joining of sections of coiled tubing can be necessitated, for example, by the lift capacity of handling equipment or the volume capacity of the work reel.

However, there are limited mechanisms and techniques that have been developed for gripping and handling sections of coiled tubing to facilitate connection of the coiled tubing sections. Accordingly, the formation of coiled tubing connections can be difficult, costly and time-consuming.

SUMMARY

In general, the present invention provides a system and a methodology for gripping and manipulating sections of coiled tubing to facilitate the formation of a connection between the sections of coiled tubing. A framework is provided with one or more vise stands having features designed to grip and manipulate the end of a coiled tubing section. This ability enables an operator to easily and consistently prepare and move ends of coiled tubing sections into engagement with a coiled tubing connector.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for connecting sections of coiled tubing. The need for connecting one segment of coiled tubing to another segment of coiled tubing arises, for example, when the required length of coiled tubing for a given application cannot be contained on a single reel as one continuous length of pipe. The required length of coiled tubing may be too great due to limited volume capacity of the work reel or limited lift capacity of the handling equipment. An assembly or installation skid is used in retrieving sections of coiled tubing from separate reels. The skid also is used to grip and manipulate the ends of each coiled tubing section to facilitate connection of the coiled tubing ends with an appropriate coiled tubing connector.

Figure 1:
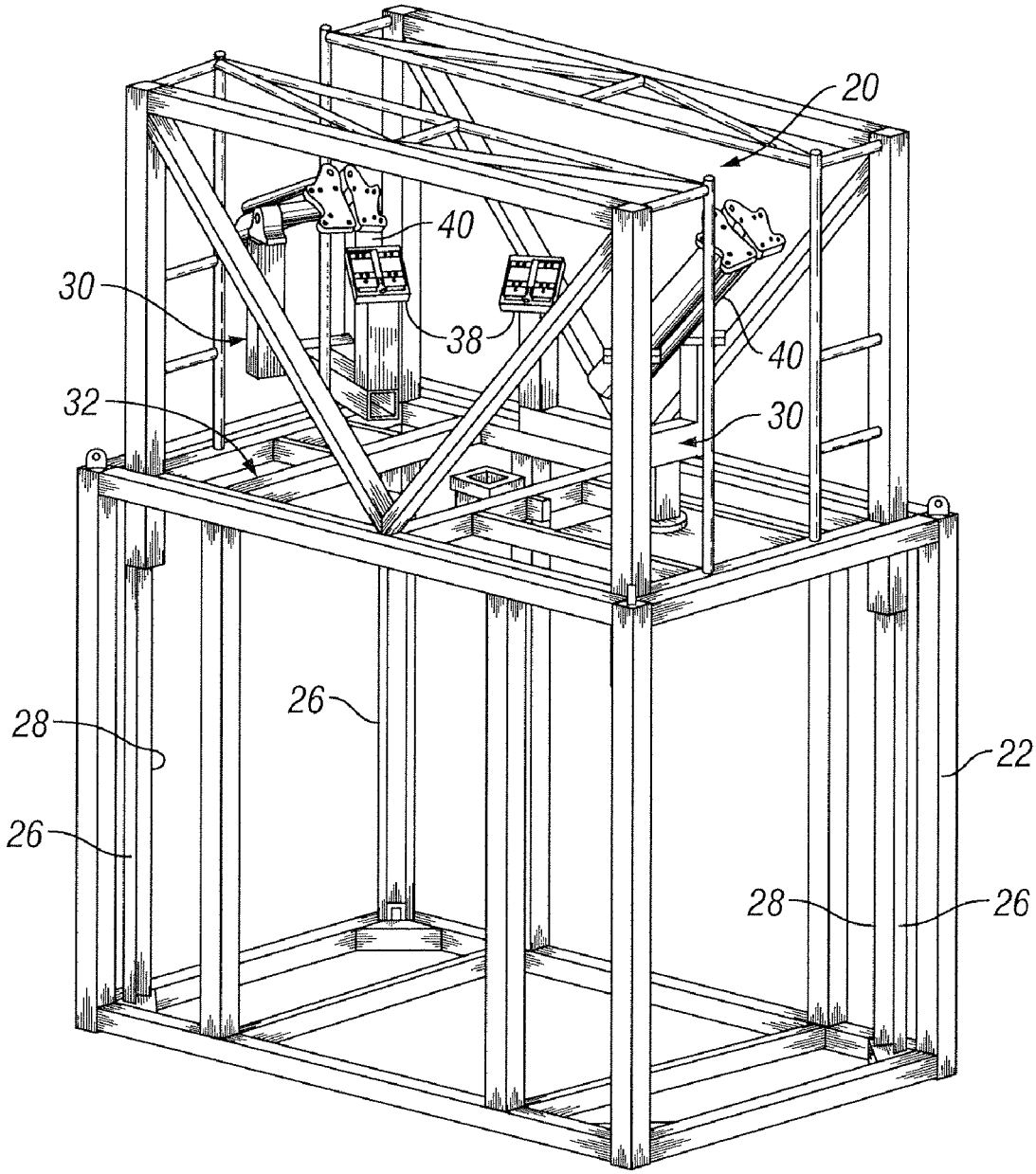
FIG. 1 illustrates an embodiment of a spoolable connector installation skid and a shipping container, according to an embodiment of the present invention.

Referring generally to FIG. 1, an embodiment of the present invention is illustrated. In this embodiment, a skid 20 is designed as a spoolable connector installation skid able to greatly facilitate the handling and connection of separate sections of coiled tubing. In the embodiment illustrated, skid 20 is housed within a shipping container 22 and mounted within a protective cage 24. The protective cage 24 may be covered with a protective layer, such as corrugated siding, to protect the work area and skid 20 from the elements at a given well site location. The skid 20 also may be mounted on extensible legs 26 sized to enable movement of skid 20 between a position fully enclosed within shipping container 22 and a position above shipping container 22, as illustrated. The extensible legs 26 may be powered by one or more lifting mechanisms, such as hydraulic cylinders 28, that enable selective movement of skid 20 between the enclosed transport position and the raised operational position. Once shipping container 22 is moved to an appropriate well site, skid 20 can be elevated above the shipping container 22, via hydraulics cylinders 28, for use in connecting sections of coiled tubing.

Figure 2:
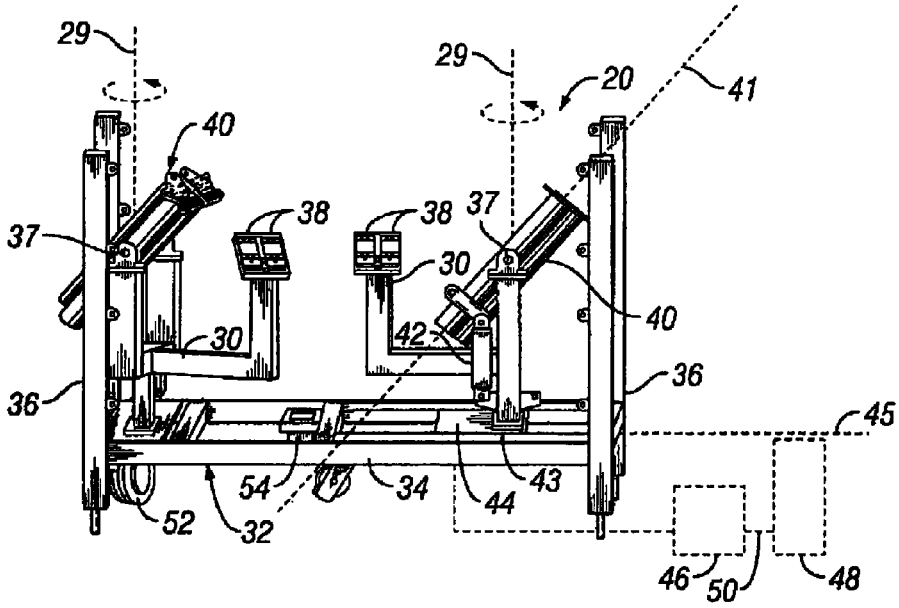
FIG. 2 is generally a side view of the spoolable connector installation skid illustrated in FIG. 1.

With additional reference to FIG. 2, further details of one embodiment of skid 20 can be described. In this embodiment, skid 20 is a spoolable connector assembly skid having at least one vise stand 30. As illustrated, two vise stands 30 may be mounted to a framework 32 having, for example, a base section 34 and side sections 36. The visestands 30 are pivotably mounted to framework 32 to facilitate alignment with the coiled tubing sections to be connected. In the specific embodiment illustrated, vise stands 30 are pivotably mounted about generally vertical axes 29, and each vise stand is designed to rotate through a desired angular span, such as plus or minus 30° about its generally vertical axis 29.

A vise 38 is mounted to each vise stand 30 to enable secure gripping of a section of coiled tubing once directed into engagement with the vise 38. In the illustrated example, a pair of vises 38 is mounted to each vise stand 30 to further secure a section of coiled tubing that is to be connected to an adjacent section of coiled tubing. A coiled tubing fairlead 40 also is mounted to each vise stand 30 and is designed to guide the section of coiled tubing to the corresponding vise or vises 38. Each coiled tubing fairlead 40 is movably mounted to its corresponding vise stand 30 to enable manipulation of the coiled tubing end as it is brought into engagement with the corresponding vise 38. By way of example, each coiled tubing fairlead 40 may be pivotably mounted to its vise stand 30 and controlled by an actuator 42, such as a hydraulic cylinder. In the specific embodiment illustrated, each coiled tubing fairlead 40 is pivotably mounted at a pivot point 37 to its vise stand 30 for pivoting motion about a generally horizontal axis 41 when moved by the extension and contraction of actuator 42. The rotatability of each vise stand 30 about its generally vertical axis 29 allows the coiled tubing fairlead 40 and the coiled tubing vises 38 to be aligned with a section of coiled tubing being pulled to skid 20 from its coiled tubing reel.

Additionally, one or both of the vise stands 30 is translatable to facilitate the actual coupling of coiled tubing sections with a coiled tubing connector once the pair of coiled tubing sections are securely gripped by vises 38. In the embodiment illustrated, one of the vises 30 (the rightmost vise 30 in FIG. 2) is linearly translatable generally along a line that moves the vise stand 30 either toward or away from the adjacent vise stand 30. The translatable vise stand 30 may be mounted to a translatable vise sled 43 selectively movable along a substantially horizontal axis 45 defined by a corresponding track 44 formed in framework 32. The translating and rotating motion of one or more vise stands 30 about the axes 29 and 45 as well as the pivoting motion of coiled tubing fairleads 40 about the pivot points 37 and axes 41 can be controlled via a hydraulic control system 46. The hydraulic system 46 and other controllable features of skid 20 may be controlled via an overall system control 48 positioned remotely from skid 20. Overall system control 48 provides appropriate inputs to the skid through, for example, an umbilical connection 50 or through a wireless connection.

Skid 20 also may comprise a winch 52 for pulling coiled tubing into engagement with coiled tubing fairleads 40 and vises 38. As discussed in greater detail below, winch 52 can be coupled to a section of coiled tubing via an appropriate pull line routed through, for example, a cable fairlead 54. The action of winch 52 also can be controlled remotely via system control 48.

Figure 3:
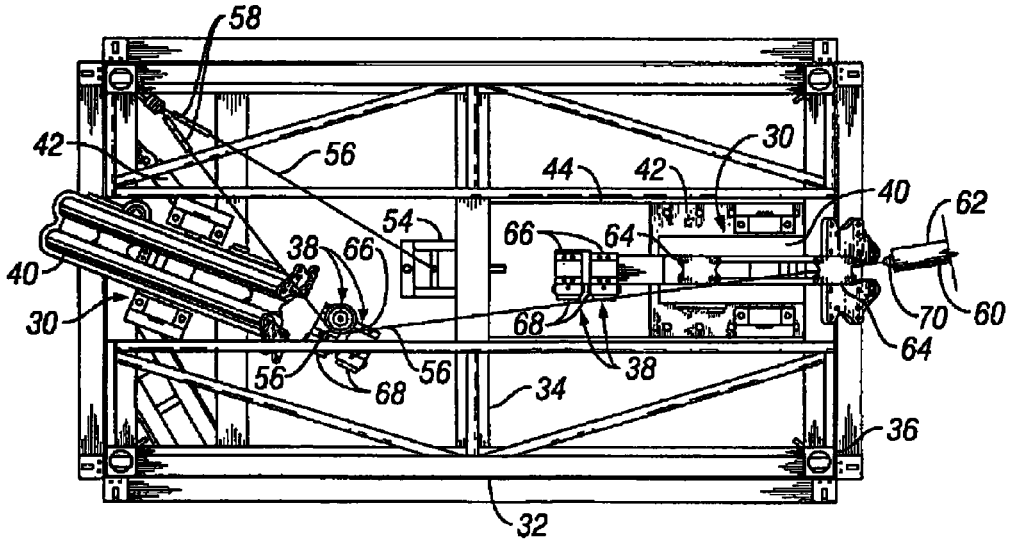
FIG. 3 is top view of the spoolable connector installation skid illustrated in FIG. 2.

As illustrated best in FIG. 3, a pull line 56, such as a cable or wire, is routed from winch 52 and through cable fairlead 54 which is mounted to base section 34 of framework 32. The pull line 56 is further routed through a series of snatch blocks 58 mounted to framework 32 in a manner to pull a coiled tubing section 60 onto skid 20 from a remotely located coiled tubing reel. The path along which pull line 56 travels is routed through the coiled tubing fairlead 40 mounted on the pivoting vise stand 30 closest to the coiled tubing reel from which the coiled tubing section 60 is drawn.

When the coiled tubing section 60 is pulled through the coiled tubing fairlead 40 and an end 62 of the coiled tubing is moved adequately past the corresponding vise 38, the vise stand 30 is rotated to align the coiled tubing with the appropriate vise 38. The corresponding coiled tubing fairlead 40 is then moved, e.g. pivoted about its horizontal axis, via extension or contraction of actuator 42 to manipulate the coiled tubing section into proper engagement with the adjacent vise or vises 38. Rollers 64 may be rotatably mounted at opposed ends of each coiled tubing fairlead 40. The rollers 64 are designed and located to engage the coiled tubing section 60 and to move the coiled tubing section into a bottom half 66 of the vises 38. A top half 68 of each vise 38 is then placed over the top of the coiled tubing section 60 and secured to firmly grip the coiled tubing section. The top half 68 and bottom half 66 of vises 38 may be joined by appropriate fasteners, such as bolts. When a corresponding coiled tubing section is moved onto the opposed vise stand, a similar procedure is used to draw the corresponding coiled tubing section from a remote reel, to manipulate it via the corresponding coiled tubing fairlead, and to secure the corresponding coiled tubing section via the corresponding vise or vises.

In the embodiment illustrated, each vise stand 30 uses a plurality of vises 38, e.g. two vises 38, to provide redundant clamping of the section of coiled tubing. Once the section of coiled tubing is securely gripped by vises 38, a cable clamp 70 is released to disconnect the pull line 56 from the section of coiled tubing. At this point, the snatch blocks 58 can be repositioned to enable the corresponding section of coiled tubing to be pulled onto an opposite side of skid 20 from a second coiled tubing reel.

Once each section of coiled tubing is securely gripped or clamped in its set of vises 38, the sections of coiled tubing and the coiled tubing ends to be connected can be manipulated freely on each vise stand 30. This facilitates the preparation of each coiled tubing end for engagement with a coiled tubing connector and also allows the ends of the coiled tubing sections to be easily aligned for connection.

Figure 4:
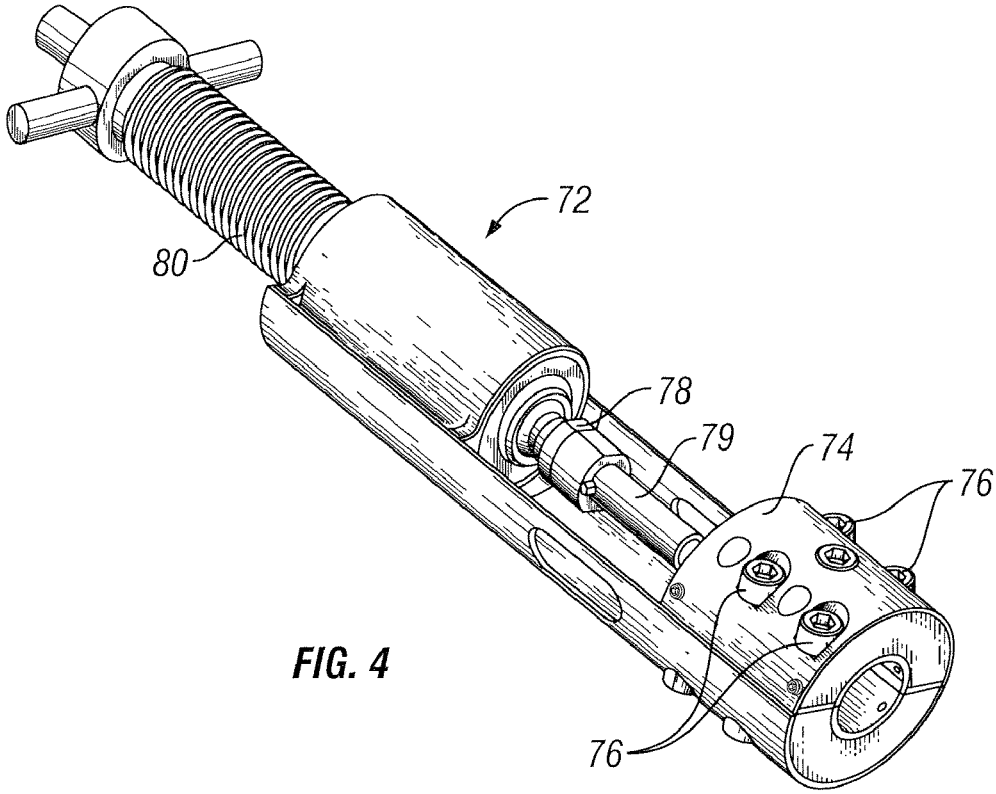
FIG. 4 is an orthogonal view of a rounding/machining fixture for preparation of a coiled tubing end, according to an embodiment of the present invention.

To prepare coiled tubing ends, e.g. coiled tubing end 62, for connection to the coiled tubing connector, a variety of procedures can be performed. For example, the interior and/or exterior of the coiled tubing end can be rounded, machined, chamfered, deformed, ground or otherwise prepared to facilitate the formation of a dependable connection. According to one procedural embodiment, the coiled tubing is initially cut perpendicular to the axis of the tubing. Then, a rounding fixture 72, such as the rounding fixture illustrated in FIG. 4, is attached to the end of the coiled tubing section by a rounding clamp 74. The inside diameter of rounding clamp 74 is sized such that when the clamp is completely closed over the end of the coiled tubing, the coiled tubing wall is stressed beyond a yield point. When the clamp 74 is removed, the tubing expands elastically a small amount but remains round at its original diameter. The rounding clamp 74 may be transitioned to its closed position by tightening a plurality of bolts 76 extending between halves of the rounding clamp. The bolts can be tightened appropriately with a manual torque wrench or an air or hydraulic torque wrench having a gear reduction drive.

After attaching rounding clamp 74 to an end of the section of coiled tubing, the inside diameter of the coiled tubing is machined. For example, a standard shell reamer tool appropriately sized for the coiled tubing connector can be installed on a rotatable shaft 78 of fixture 72. In this embodiment, shaft 78 has a standard machine tool taper 79 designed for mating engagement with a conventional shell reamer. The shaft 78 may be rotated by hand or with an air or hydraulic drill or ratchet. As the shell reamer is turned, a fixture lead screw 80 is rotated and advances shaft 78 and the shell reamer into an interior of the coiled tubing. This machining action cuts the inside diameter of the coiled tubing to the correct bore diameter for engagement with a coiled tubing connector. The shell reamer is advanced until the bore is machined to the required depth, and then removed from the coiled tubing. Upon removal of the shell reamer, a chamfering tool is placed on the machine tool taper 79 of shaft 78. The coiled tubing is then chamfered as desired for the specific type of spoolable coiled tubing connector. The rounding clamp 74 is then removed, and an air or hydraulic powered honing device can be run into the machine bore of the coiled tubing to finish the machining process. Of course, a variety of other end conditioning procedures can be incorporated into preparation of the coiled tubing for engagement with a coiled tubing connector.

Figure 5:
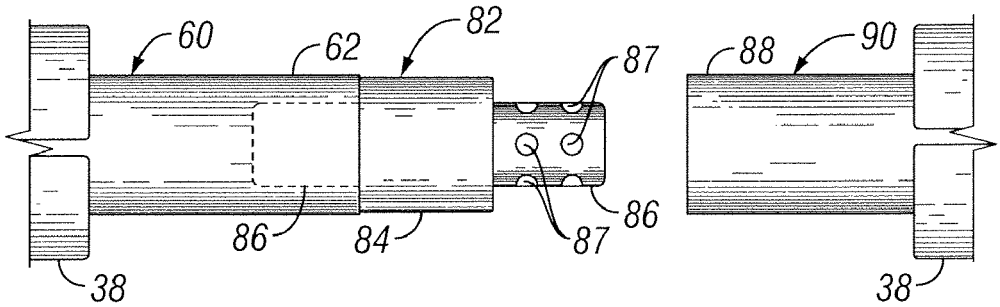
FIG. 5 is a side view of two coiled tubing sections held by the spoolable connector installation skid for movement into engagement, according to an embodiment of the present invention.

Upon finalizing preparation of the coiled tubing end or ends, a spoolable, coiled tubing connector is engaged with one end of the coiled tubing, as illustrated in FIG. 5. Although other types of coiled tubing connectors can be used, the illustrated example comprises a coiled tubing connector 82 having a radially expanded center region 84 and radially smaller insertion portions 86 that are each sized for insertion into the appropriately prepared coiled tubing end. The insertion portions 86 may be designed with a variety of retention mechanisms to enable secure connections between the coiled tubing connector and the corresponding sections of coiled tubing. For example, each insertion portion 86 may comprise one or more recesses 87 into which the coiled tubing ends are deformed. The recesses may be machined into each insertion portion and may comprise grooves, dimples, or other recesses into which each coiled tubing end is plastically deformed to secure the connection.

Also, the center region 84 may be constructed with a diameter similar or the same as the diameter of the sections of coiled tubing to be joined. Using the same or similar diameter facilitates spoolability of the connector and coiled tubing. In the embodiment illustrated, end 62 of coiled tubing section 60 is to be joined with a corresponding coiled tubing end 88 of a corresponding section of coiled tubing 90 via coiled tubing connector 82.

Figure 6:
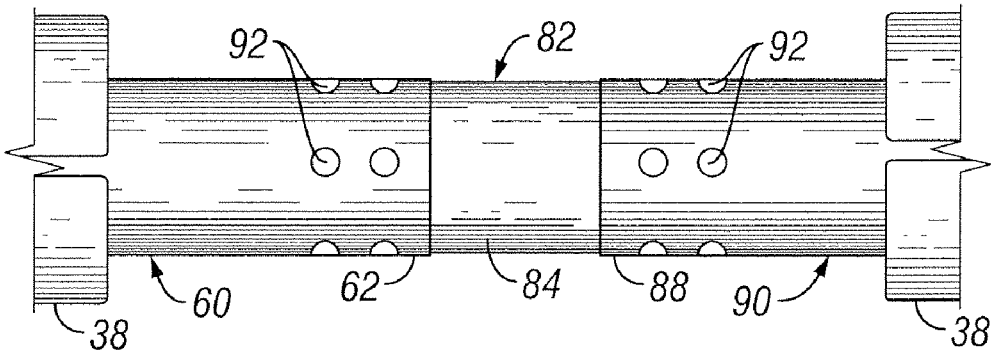
FIG. 6 is a side view similar to that of FIG. 5 but showing the two coiled tubing sections connected together, according to an embodiment of the present invention

The coiled tubing sections 60 and 90 are securely gripped and held by their corresponding vises 38. Accordingly, upon insertion of coiled tubing connector 82 into one of the coiled tubing ends 62 or 88, one or both of the vise stands are rotated until the sections of coiled tubing are aligned. Once aligned, the translating vise stand 30 is moved via translating vise sled 42 toward the opposite vise stand 30. The relative movement of the vise stands toward each other is continued until the second half of coiled tubing connector 82 is fully engaged, as illustrated in FIG. 6.

Once the two ends of the spoolable coiled tubing connector 82 are fully inserted into ends 62 and 88 of the sections of coiled tubing 60 and 90, respectively, the connection may be secured. As further illustrated in FIG. 6, connection of the coiled tubing section to coiled tubing connector 82 can be secured by plastically deforming the ends of the coiled tubing sections into corresponding recesses 87 on the insertion portions 86 of the coiled tubing connector 82. For example, a plurality of depressions 92 can be pressed into the exterior of coiled tubing ends 62 and 88 to form internally directed protrusions positioned to match corresponding recesses 87, thereby securing the coiled tubing sections to the coiled tubing connector.

Figure 7:
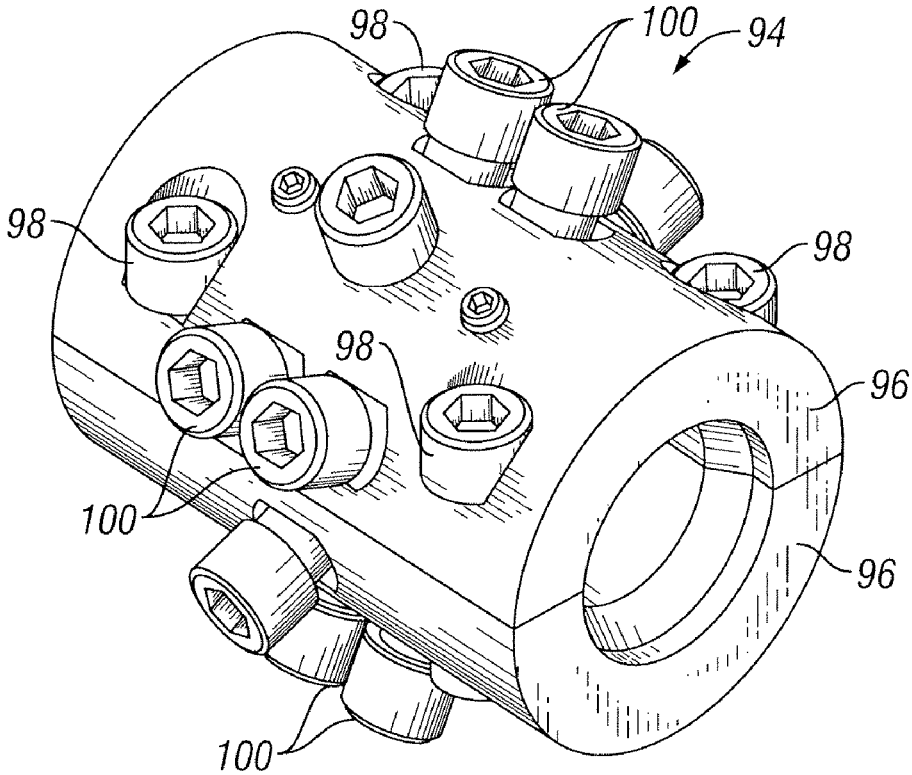
FIG. 7 is an orthogonal view of a fixture for deforming the ends of the coiled tubing sections to secure engagement with the coiled tubing connector, according to an embodiment of the present invention.

A fixture 94 can be used to form the properly positioned protrusions, e.g. dimples. One example of such a fixture is illustrated in FIG. 7. In this embodiment, fixture 94 comprises a screw type dimpling fixture having separable housing portions 96 that may be released from each other or secured together by appropriate fasteners, such as bolts 98. Each housing portion 96 has an arcuate interior shaped to clamp against an end of the coiled tubing when bolts 98 are tightened. Once tightened against the coiled tubing in the proper orientation, a plurality of dimpling screws 100 are tightened to deform the coiled tubing material inwardly into corresponding recesses 87. The dimpling screws 100 can be turned with, for example, hand tools, air or hydraulic ratchets, air or hydraulic torque wrenches with gear reduction drives or other tightening tools. Additionally, fixture 94 can be designed with an appropriate guide pin or other type of guide feature positioned to mate with a corresponding guide feature located on the coiled tubing or coiled tubing connector. The guide features ensure that fixture 94 is properly positioned such that rotation of dimpling screws 100 deforms the coiled tubing into the recesses 87 formed in the coiled tubing connector. After securing one section of coiled tubing to the coiled tubing connector 82, bolts 98 are loosened and fixture 94 is moved to the opposite side of coiled tubing connector 82. The bolts 98 are again tightened, and dimpling screws 100 are rotated to deform the opposite section of coiled tubing into corresponding recesses formed in connector 82.

Fixture 94 can be formed in a variety of configurations with many types of deformation mechanisms designed to deform the coiled tubing as necessary to interfere with recesses of various sizes and shapes within the coiled tubing connector 82. Additionally, the fixture 94 can be designed as a longer fixture that spans both sides of coiled tubing connector 82. In this latter embodiment, all of the dimples or other deformations can be formed with a single attachment of the fixture 94 rather than moving the fixture from one side of the coiled tubing connector to the other.

The shape and configuration of components used to grip, manipulate and prepare the sections of coiled tubing for connection can be changed depending on the desired application. Also, other components can be added or interchanged as necessary to facilitate specific coiled tubing connection applications. The size and strength of various components also can be adjusted depending on, for example, the length and diameter of the coiled tubing sections being combined.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. An apparatus for connecting coiled tubing, comprising:

a framework;

a pair of rotatable assemblies mounted to the framework, the assemblies rotatable about generally vertical axes;

a gripping mechanism mounted to each rotatable assembly; and a coiled tubing fairlead pivotably mounted to each rotatable assembly to guide a section of coiled tubing to the gripping mechanism, the fairleads pivotable about generally horizontal axes, the rotatable assemblies rotatable and the fairleads pivotable while guiding the section of coiled tubing to the gripping mechanism, wherein one of the fairleads assemblies is linearly translatable toward the other fairlead.

2. The apparatus as recited in claim 1, wherein the rotatable assemblies are vise stands.

3. The apparatus as recited in claim 1, wherein the gripping mechanism is a vise.

4. The apparatus as recited in claim 1, wherein at least one of the fairleads is also translatable.

5. The apparatus as recited in claim 1, further comprising a protective cage generally surrounding the pair of pivotable assemblies.

6. The apparatus as recited in claim 1, wherein the framework comprises extensible legs for selectively raising the pair of pivotable assemblies.

7. The apparatus as recited in claim 1, further comprising: a pull line to pull a section of coiled tubing into proximity with one of the pivotable assemblies; and a plurality of snatch blocks to guide the pull line.

8. A method of connecting coiled tubing, comprising:

rotating a rotatable assembly to align a coiled tubing fairlead with a section of coiled tubing, the assembly rotatable about a vertical axis;

manipulating the coiled tubing fairlead about a horizontal axis to move the section of coiled tubing into a gripping mechanism by moving the section of coiled tubing axially with the aid of at least one roller and pivoting the coiled tubing fairlead with a hydraulic cylinder about a generally horizontal axis;

holding the section of coiled tubing in the gripping mechanism;

preparing an end of the section of coiled tubing; and inserting a coiled tubing connector into the end of the section of coiled tubing.

9. The method as recited in claim 8, further comprising aligning a second coiled tubing fairlead with a corresponding section of coiled tubing.

10. The method as recited in claim 9, further comprising: manipulating the corresponding section of coiled tubing into a second pivotable assembly; and holding the corresponding section of coiled tubing in the second pivotable assembly.

11. The method as recited in claim 10, further comprising translating at least one of the gripping mechanism and the second gripping mechanism along a substantially horizontal axis to move the connector and the corresponding section of coiled tubing into engagement.

12. The method as recited in claim 11, further comprising securing the section of coiled tubing and the corresponding section of coiled tubing to the connector by deforming the section of coiled tubing and the corresponding section of coiled tubing.

13. The method as recited in claim 8, wherein preparing comprises at least rounding the end of the section of coiled tubing.

14. The method as recited in claim 13, wherein rounding comprises attaching a rounding clamp to the end of the section of coiled tubing.

15. The method as recited in claim 14, further comprising machining an interior diameter of the end of the section of coiled tubing for engagement with the coiled tubing connector.

16. The method as recited in claim 14, further comprising chamfering the end of the section of coiled tubing for engagement with the coiled tubing connector.

17. A system for connecting coiled tubing, comprising:

a framework;

a vise stand rotatably mounted to the framework and translatable along the framework, the vise stand rotatable about a generally vertical axis and translatable along a substantially horizontal axis;

a movable coiled tubing fairlead mounted to the vise stand to manipulate a section of coiled tubing, the vise stand rotatable and translatable while manipulating the coiled tubing; and a vise mounted to the vise stand to hold the section of coiled tubing.

18. The system as recited in claim 17, wherein the vise comprises a pair of vises to hold the section of coiled tubing.

19. The system as recited in claim 17, wherein the coiled tubing fairlead is pivotable about a generally horizontal axis for manipulating the section of coiled tubing.

20. A method of connecting coiled tubing, comprising:

rotating a rotatable assembly to align a coiled tubing fairlead with a section of coiled tubing, the assembly rotatable about a vertical axis;

manipulating the coiled tubing fairlead about a horizontal axis to move the section of coiled tubing into a gripping mechanism;

holding the section of coiled tubing in the gripping mechanism;

preparing an end of the section of coiled tubing;

inserting a coiled tubing connector into the end of the section of coiled tubing;

aligning a second coiled tubing fairlead with a corresponding section of coiled tubing manipulating the corresponding section of coiled tubing into a second pivotable assembly;

holding the corresponding section of coiled tubing in the second pivotable assembly translating at least one of the gripping mechanism and the second gripping mechanism along a substantially horizontal axis to move the connector and the corresponding section of coiled tubing into engagement.

21. The method as recited in claim 20, wherein manipulating comprises moving the section of coiled tubing axially with the aid of at least one roller.

22. The method as recited in claim 21, wherein manipulating comprises pivoting the coiled tubing fairlead with a hydraulic cylinder about a generally horizontal axis.

23. The method as recited in claim 20, further comprising securing the section of coiled tubing and the corresponding section of coiled tubing to the connector by deforming the section of coiled tubing and the corresponding section of coiled tubing.

24. The method as recited in claim 20, wherein preparing comprises at least rounding the end of the section of coiled tubing.

25. The method as recited in claim 24, wherein rounding comprises attaching a rounding clamp to the end of the section of coiled tubing.

26. The method as recited in claim 25, further comprising machining an interior diameter of the end of the section of coiled tubing for engagement with the coiled tubing connector.

27. The method as recited in claim 25, further comprising chamfering the end of the section of coiled tubing for engagement with the coiled tubing connector.

* * * * *